US008277039B2

(12) United States Patent
Nakamaki et al.

(10) Patent No.: US 8,277,039 B2
(45) Date of Patent: Oct. 2, 2012

(54) INKJET PRINTER AND A PAPER TRANSPORTATION METHOD

(75) Inventors: Motohiro Nakamaki, Azumino (JP); Junichi Arai, Chiryu (JP)

(73) Assignee: Seiko Epson Corporation, Tokyo (JP)

( * ) Notice: Subject to any disclaimer, the term of this patent is extended or adjusted under 35 U.S.C. 154(b) by 687 days.

(21) Appl. No.: 12/412,310

(22) Filed: Mar. 26, 2009

(65) Prior Publication Data

US 2009/0244246 A1 Oct. 1, 2009

(30) Foreign Application Priority Data

Mar. 27, 2008 (JP) ..... 2008-082855

(51) Int. Cl.

| | |
|---|---|
| ***B41J 2/01*** | (2006.01) |
| ***B41J 29/38*** | (2006.01) |
| ***B41J 11/20*** | (2006.01) |
| ***B41J 15/00*** | (2006.01) |

(52) U.S. Cl. ..... 347/104; 347/5; 347/101; 400/55; 400/578

(58) Field of Classification Search ..... 347/5, 16, 347/30, 101, 104; 226/1, 93, 95; 400/55, 400/578, 611, 612, 619
See application file for complete search history.

(56) References Cited

U.S. PATENT DOCUMENTS

| | | | |
|---|---|---|---|
| 5,369,424 A | 11/1994 | Hori et al. | |
| 7,422,320 B2 | 9/2008 | Sugiura | |
| 2004/0174421 A1* | 9/2004 | Tsuji | 347/104 |

FOREIGN PATENT DOCUMENTS

| | | |
|---|---|---|
| JP | 05-008466 A | 1/1993 |
| JP | 06-135071 A | 5/1994 |
| JP | 2003-136791 A | 5/2003 |
| JP | 2004-299865 A | 10/2004 |
| JP | 2007-153602 A | 6/2007 |

* cited by examiner

*Primary Examiner* — Charlie Peng
*Assistant Examiner* — Hung Lam
(74) *Attorney, Agent, or Firm* — Kilpatrick Townsend & Stockton LLP

(57) ABSTRACT

An inkjet printer prevents the paper from lifting away from the platen when the suction action of the platen is stopped, and thereby prevents paper jams and other printing problems. The printer 1 conveys the printing paper 12*a* while holding the paper 12*a* to the surface of the platen 19 by a suction mechanism 50. After the automatic paper cutting operation is completed, the leading end part 12*b* of the printing paper 12*a* is retracted from the cutting position B to the printing start position A on the platen 19, and the printer 1 waits for the next print job with the printing paper 12*a* held against the platen 19. When a power conservation mode or power off mode is entered, the control unit 61 of the printer 1 advances the leading end part 12*b* of the printing paper 12*a* from the printing start position A to the cutting position B so that the paper is held by the downstream-side paper feed roller 34 and pressure roller 35, and then stops the power supply to the suction mechanism 50 of the platen 19. The printing paper 12*a* can thus be prevented from rising away from the platen 19 while the vacuum action of the suction mechanism 50 is stopped.

17 Claims, 8 Drawing Sheets

INKJET PRINTER AND A PAPER TRANSPORTATION METHOD

This application claims priority to Japanese Patent Application No. 2008-082855 filed on Mar. 27, 2008, the entire disclosure of which is expressly incorporated by reference herein.

BACKGROUND OF THE INVENTION

1. Field of Invention

The present invention relates generally to a printer that prints on a recording medium such as paper, and relates more particularly to an inkjet printer in which the platen opposite the inkjet head has a suction mechanism for holding the recording paper, and relates further to a method of transporting the recording paper in this inkjet printer.

2. Description of Related Art

Printers that hold and print to recording paper that is wound in a roll ("roll paper" below) convey the recording paper pulled off the roll through a transportation path passed a printing position at the platen opposite the print head and a cutting position near the roll paper exit. In order to prepare for the next print job after cutting the printed paper at the cutting position by means of an automatic paper cutter, printers of this type according to the related art reverse the leading end of the paper after cutting off the printed portion from the cutting position toward the printing start position (the print head position) and then wait for the next print job with the paper set to the printing start position.

The end of the recording paper may also be curled. The end of recording paper that is wound into a roll in particular tends to curl, and such curling increases when relatively stiff paper is used. When the leading end of the roll paper is rewound to the printing start position, the leading end is left at the platen without being held by the paper feed rollers. Because the leading end of the paper is curled when thus left at the platen, the curled paper leads to paper jams or interference with the print head, and can thus cause printing problems. Japanese Unexamined Patent Appl. Pub. JP-A-2007-153602 therefore teaches an inkjet printer that has a suction mechanism for pulling the recording paper tight to the platen surface through holes disposed in the surface of the platen in order to hold the end of the paper pulled from the paper roll flat against the platen at the printing position.

The inkjet printer having a platen with a suction mechanism as taught in JP-A-2007-153602 prevents the recording paper from lifting off the platen by means of suction when in the standby mode with the leading end of the paper retracted to the printing start position. However, when this standby mode lasts long enough that the printer enters a power conservation mode or the printer power turns off, interruption of the power supply also causes the suction mechanism of the platen to stop operating. When this happens the paper is not held to the platen, allowing the leading end of the paper to curl and lift away from the platen surface. When the power conservation mode ends or the power turns on again to resume printing, the curled paper tends to interfere with the print head or paper feed rollers, resulting in a paper jam or possibly defective printing.

SUMMARY OF THE INVENTION

An inkjet printer having a suction mechanism for holding the paper to the platen according to at least one embodiment of the present invention can hold the paper so that the paper does not lift off the transportation path after the suction mechanism stops operating because the inkjet printer enters a power conservation mode during standby or the power turns off, and can thereby prevent paper jams and printing problems when operation resumes.

A first aspect of the invention is an inkjet printer having an inkjet head; a platen opposing the inkjet head; a transportation path for conveying paper; a paper feed mechanism for conveying the paper through the transportation path; a suction mechanism for pulling the paper to the platen; and a control unit that conveys the paper by means of the paper feed mechanism so that at least the leading end part of the paper is held by the paper feed mechanism if at least the leading end part of the paper is not held by the paper feed mechanism when stopping the suction operation of the suction mechanism.

Preferably, the control unit conveys the paper by means of the paper feed mechanism so that at least the leading end part of the paper is held by the paper feed mechanism if at least the leading end part of the paper is not at the position of the inkjet head when stopping the suction operation of the suction mechanism.

Further preferably, the paper feed mechanism includes at least a paper feed roller pair located on the downstream side of the platen; and the control unit conveys the paper by means of the paper feed mechanism so that at least the leading end part of the paper is held by the paper feed roller pair if at least the leading end part of the paper is not held by the paper feed roller pair when stopping the suction operation of the suction mechanism.

Yet further preferably, the paper feed mechanism includes at least a downstream-side paper feed roller pair located on the downstream side of the platen, and an upstream-side paper feed roller pair located on the upstream side of the platen; and the control unit conveys the paper by means of the paper feed mechanism so that at least the leading end part of the paper is held by the downstream-side paper feed roller pair or the upstream-side paper feed roller pair if at least the leading end part of the paper is not held by the downstream-side paper feed roller pair when stopping the suction operation of the suction mechanism.

This embodiment of the invention can pull the paper to the platen surface by means of the vacuum action of the suction mechanism. When this vacuum action of the suction mechanism is stopped, the paper is held by the paper feed mechanism. The paper can thus always be held so that the paper does not lift off the platen or other part of the transportation path near the inkjet head.

In addition, because a paper feed roller is used as the means of holding the paper when the suction mechanism is stopped, it is not necessary to add new parts for only holding the paper when the suction mechanism stops.

In another aspect of the invention the control unit stops the suction operation of the suction mechanism when the inkjet printer is set to a power conservation mode or a power off mode.

When the power conservation mode or power off mode is entered, all or part of the power supply to the drive units and other parts of the printer is stopped, and the suction mechanism therefore also stops operating. Even in this situation, however, at least one embodiment of the invention holds the paper by means of the paper feed rollers so that the paper does not rise away from the platen or other part of the transportation path. Paper jams and other printing problems can therefore be prevented when normal operation is resumed from the power conservation mode or the power off mode.

In another aspect of the invention the control unit conveys at least the leading end part of the paper to the position of the inkjet head on the platen (the printing start position) by means of the transportation mechanism when resuming the suction operation of the suction mechanism.

This aspect of the invention enters the printing standby mode with the paper positioned to the printing start position after the suction operation of the suction mechanism is resumed, and can therefore quickly start printing when the next print command is received.

Further preferably, the inkjet printer also has a roll paper compartment that holds roll paper composed of the paper wound in a roll.

In an inkjet printer that prints to paper that is delivered from a paper roll and therefore has a natural curl to the paper, the paper tends to naturally curl up and lift away from the transportation path. However, by holding the paper by means of the paper feed mechanism when the suction operation of the suction mechanism is stopped, paper jams and other printing problems can be prevented when printing resumes.

An inkjet printer according to another aspect of the invention also has a cutting mechanism disposed to the downstream side of the transportation path for cutting the paper, and the control unit conveys the paper until the leading end part of the paper reaches the cutting mechanism if at least the leading end part of the paper is not held by the paper feed mechanism when stopping the suction operation of the suction mechanism.

Because the leading end part of the paper can thus be stopped at the same position as when the paper is cut, it is not necessary to set a different position for stopping the paper when the suction mechanism stops. Transportation control of the paper can therefore be simplified.

Another aspect of the invention is a paper transportation method for an inkjet printer that has an inkjet head, a platen opposing the inkjet head, a transportation path for conveying paper, a paper feed mechanism for conveying the paper through the transportation path, and a suction mechanism for pulling the paper to the platen. The paper transportation method has steps of: conveying at least the leading end part of the paper by means of the paper feed mechanism to the position of the inkjet head and waiting in a standby mode with suction applied to the paper by the suction mechanism; and conveying at least the leading end part of the paper to a position where it is held by the paper feed mechanism when the suction operation of the suction mechanism is stopped in the standby mode.

Preferably, at least the leading end part of the paper is conveyed to the position of the inkjet head when suction by the suction mechanism is resumed.

Further preferably, the suction operation of the suction mechanism is stopped when the inkjet printer is set to a power conservation mode or a power off mode.

Yet further preferably, the inkjet printer also has a cutting mechanism for cutting the paper, and the paper transportation method also has steps of: conveying the paper to the paper cutting mechanism and cutting the paper; conveying the leading end part of the paper after being cut to the inkjet head position (printing start position), applying suction to the paper by means of the suction mechanism, and then waiting; and conveying at least the leading end part of the paper to a position where it is held by the paper feed mechanism when suction by the suction mechanism is stopped while waiting, thereby preventing the part of the paper that is positioned on the surface of the platen from lifting off said surface.

In another aspect of the invention at least the leading end part of the paper is conveyed to the inkjet head position when resuming suction by the suction mechanism.

The paper transportation method for an inkjet printer according to at least one embodiment of the present invention stands ready for the next print job with the leading end of the paper after the paper is cut positioned to the inkjet head at the printing start position, and the paper is always held by either the suction mechanism or the paper feed mechanism so that the paper does not rise from the transportation path. Paper jams and other printing problems can therefore be prevented.

Furthermore, because the paper can be positioned to the printing start position in a standby mode after the suction operation resumes, printing can start quickly when the next print command is received.

This present invention can thus pull the leading end of the paper to the surface of the platen by means of a suction mechanism. When the vacuum action of the suction mechanism is stopped, the leading end of the paper can be held by a paper feed mechanism, such as a paper feed roller pair, located on the downstream side of the platen. Because the paper can thus always be held so that the paper does not lift off away from the transportation path, paper jams and other printing problems can be prevented.

In addition, because a paper feed roller or other paper feed mechanism is used as the means of holding the paper when the suction mechanism is stopped, it is not necessary to add new parts for only holding the paper when the suction mechanism stops. The configuration of the printer can therefore be simplified.

Other objects and attainments together with a fuller understanding of the invention will become apparent and appreciated by referring to the following description and claims taken in conjunction with the accompanying drawings.

DESCRIPTION OF PREFERRED EMBODIMENTS

A printer according to a preferred at least one embodiment of the present invention is described below with reference to the accompanying figures.

Figure 1:
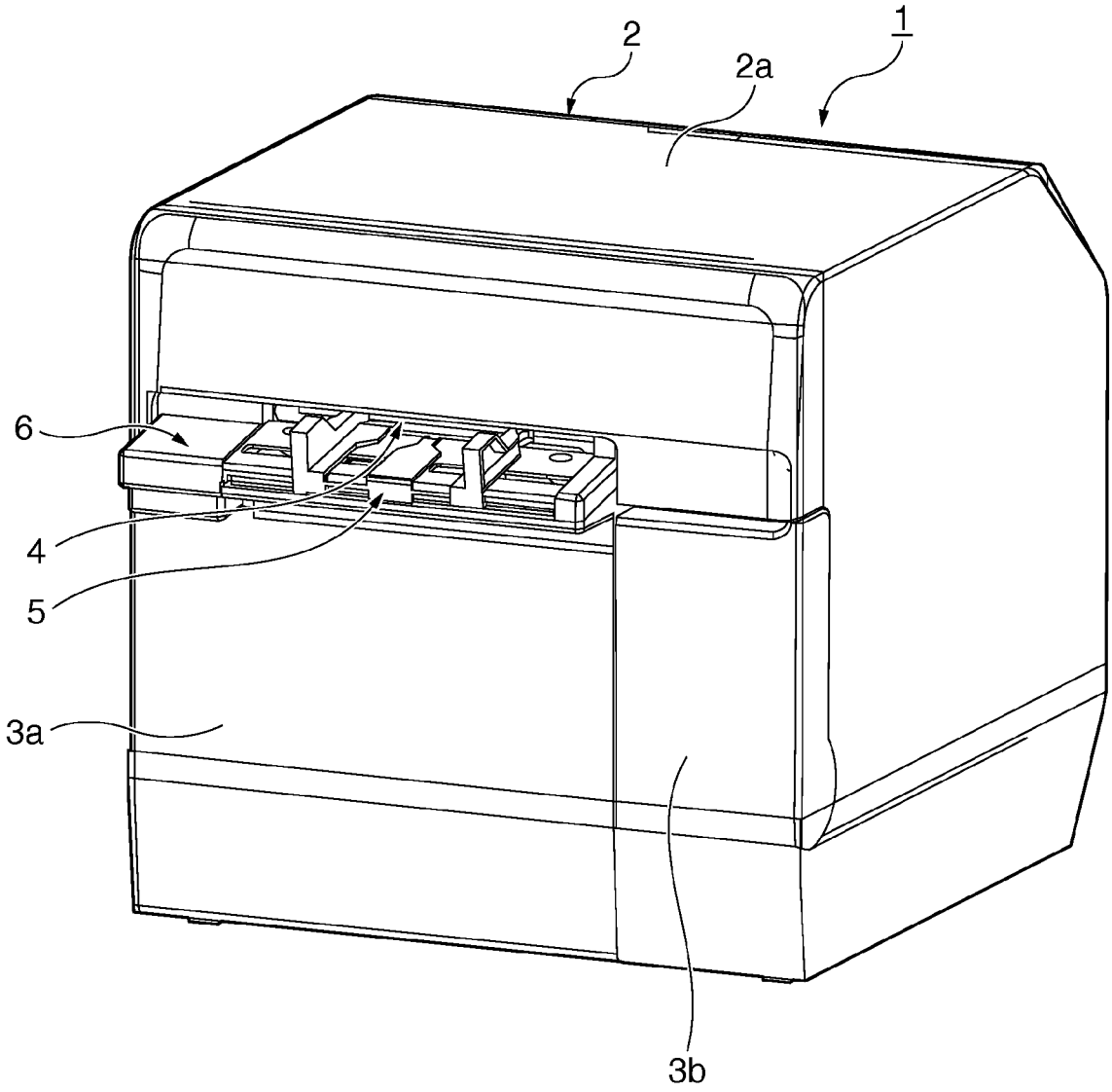
FIG. 1 is an external oblique view of a printer according to a preferred at least one embodiment of the invention.
Figure 2:
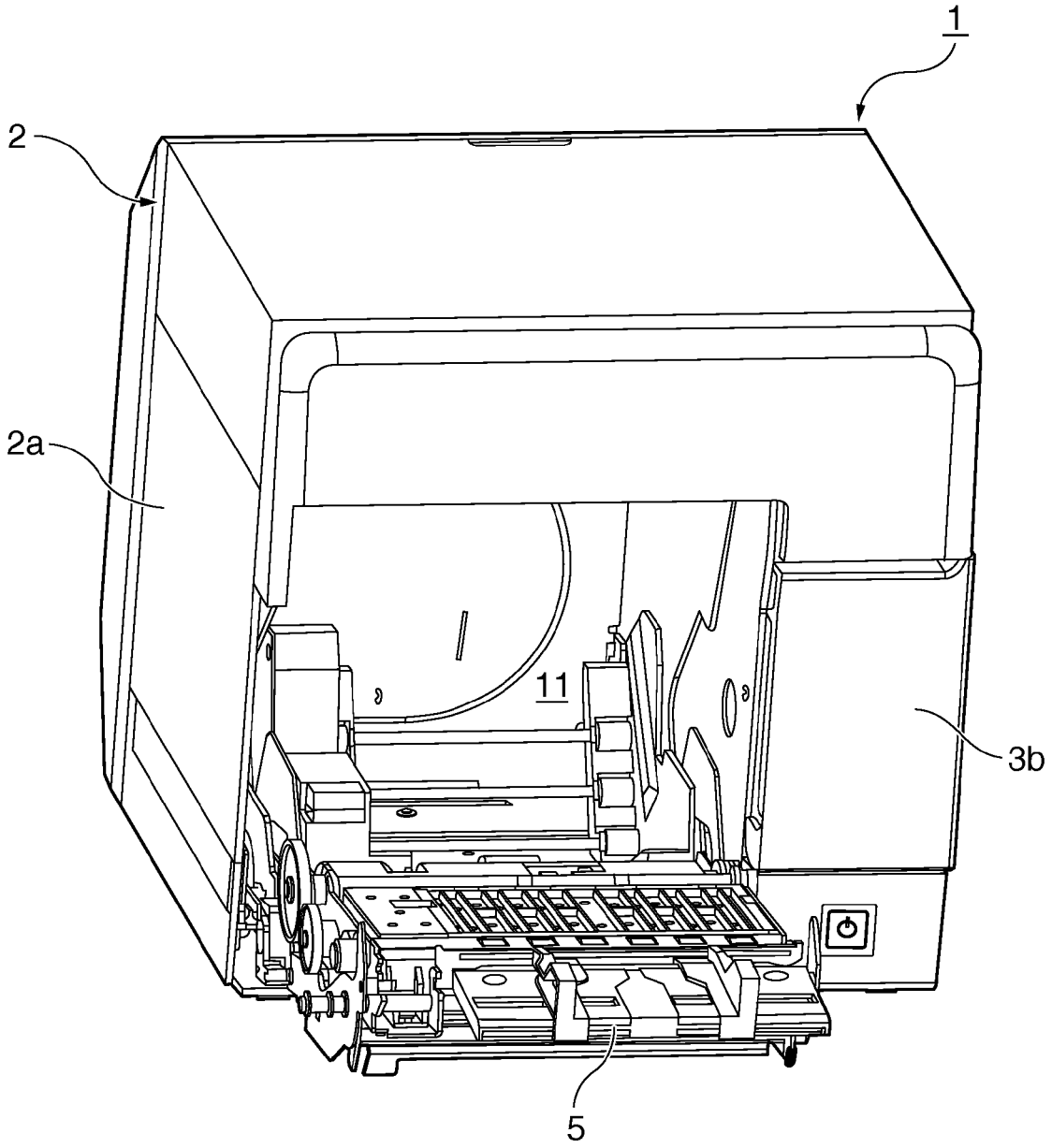
FIG. 2 is an external oblique view of the printer with the access cover open.

FIG. 1 is an oblique external view showing printer 1 according to a first embodiment of the invention. In this embodiment of the invention the printer 1 is an inkjet printer that has a serial inkjet head and an automatic paper cutter (paper cutting mechanism). FIG. 2 is an oblique view of the same printer with the roll paper cover completely open.

The printer 1 has a roll paper cover 3*a* and an ink cartridge cover 3*b* attached side by side at the front of the outside case 2*a* of the basically rectangular box-like printer case 2. The roll paper cover 3*a* and ink cartridge cover 3*b* are attached so that they can open to the front of the printer.

A paper exit 4 of a specific width is formed at the front of the outside case 2*a* above the roll paper cover 3*a*. An exit guide 5 projects to the front from the bottom of the paper exit 4, and a cover opening lever 6 is disposed beside the exit guide 5.

Operating the cover opening lever 6 unlocks the roll paper cover 3*a*. When the exit guide 5 is pulled forward after the lock is released, the roll paper cover 3*a* pivots at the bottom end part thereof and opens forward to a substantially horizontal position. As shown in FIG. 2, when the roll paper cover 3*a* opens, the roll paper compartment 11 formed inside the printer opens. The recording paper transportation path from the roll paper compartment 11 to the paper exit 4 also opens simultaneously, and the roll paper can be easily replaced from the front of the printer.

When the ink cartridge cover 3*b* is opened forward, the ink cartridge holder in which an ink cartridge containing ink is loaded opens so that the ink cartridge can be easily installed or removed.

Note that the roll paper cover 3*a* and the cover opening lever 6 are not shown in FIG. 2.

Figure 3A:
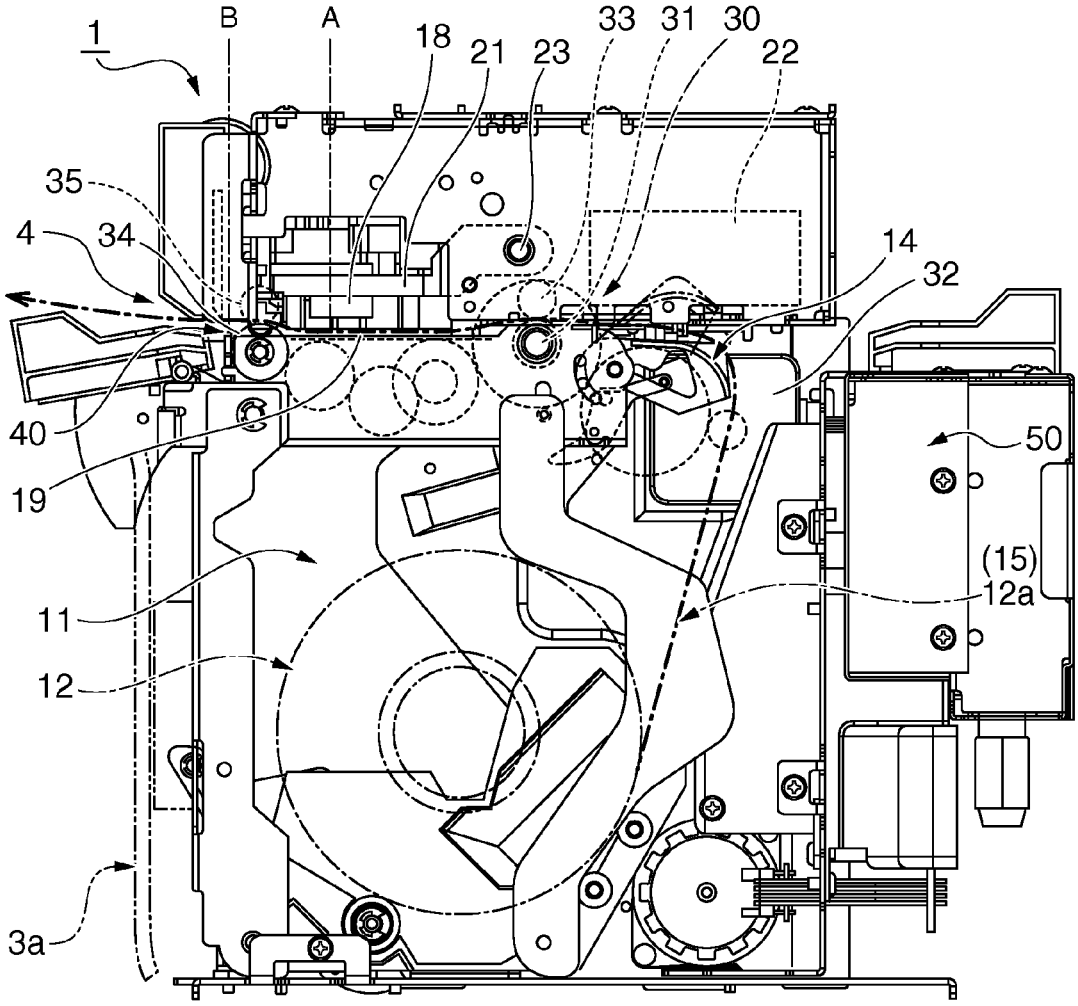
FIG. 3 is a schematic section view showing the internal structure of the printer.

FIG. 3A is a schematic section view showing the internal configuration of the printer 1. Roll paper 12 is stored inside the roll paper compartment 11 rendered inside the printer 1 so that the roll paper 12 can roll on its side between the sides of the printer. The roll paper 12 is a length of printing paper 12*a* (indicated by the bold dot-dash line in the figure) wound into a roll. The printing paper 12*a* (continuous paper) is pulled off the roll paper 12 stored in the roll paper compartment 11, and is conveyed by a paper feed mechanism 30 through the paper transportation path 15 (the same path as the dot-dash line indicating the printing paper 12*a*) inside the printer case 2 and out from the paper exit 4.

The transportation path 15 travels diagonally up from the roll paper 12, changes direction as it travels around a curved paper guide 14, and then continues horizontally to the paper exit 4 at the front of the printer. The paper guide 14 keeps a predetermined amount of tension applied to the printing paper 12*a* on the transportation path 15.

The horizontal portion of the paper transportation path 15 is positioned directly above the roll paper compartment 11. The inkjet head 18 and platen 19 are disposed vertically opposed to each other at this horizontal portion of the transportation path with a predetermined gap therebetween, and the printing position is determined by the platen 19 and the inkjet head 18.

The platen 19 is a vacuum platen to which the suction mechanism 50 (see FIG. 5) described below is connected, and can thereby pull and hold the printing paper 12*a* passing over the platen against the platen surface so that the paper does not lift away from the platen. The leading end part 12*b* (see FIG. 7) of the printing paper 12*a* delivered from the roll paper 12 is positioned to the printing start position 12A of the platen 19 in preparation for the next print job after each print job is completed or the paper is replaced.

Figure 3B:
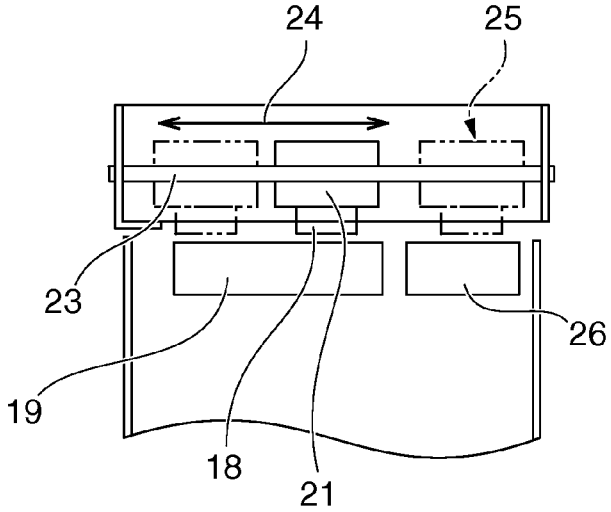

FIG. 3B is a vertical section view of the part where the inkjet head 18 is disposed in the printer 1. The inkjet head 18 is a serial print head that is carried on a head carriage 21. The head carriage 21 moves bidirectionally along a carriage guide shaft 23 that is disposed horizontally widthwise between the sides of the printer by means of a carriage motor 22. The inkjet head 18 prints to the printing paper 12*a* conveyed over the platen 19 while travelling bidirectionally over the platen 19 through the printing area 24. When in the printing standby mode, the inkjet head 18 is positioned to a home position 25 that is removed horizontally to the side from the printing area 24. A head maintenance unit 26 having a nozzle cap (not shown in the figure) is disposed below the home position 25. The head maintenance unit 26 is used to apply a head cleaning process to the inkjet head 18 and execute a nozzle check operation to detect faulty nozzles as known from the literature.

The printing paper 12*a* is conveyed forward (the direction approaching the paper exit 4) or reverse (the direction returning to the paper guide 14) along the horizontal part of the transportation path 15. The paper feed mechanism 30 holds the printing paper 12*a* by means of paper feed roller pairs on the upstream and downstream sides of the platen 19, and conveys the printing paper 12*a* in the forward or reverse direction by synchronously driving the paper feed rollers forward or reverse.

More specifically, an upstream-side paper feed roller 31 is disposed to the transportation path 15 widthwise between the sides of the printer before the platen 19, that is, on the upstream side in the paper transportation direction.

A downstream-side paper feed roller 34 (a part of the paper feed roller pair) that turns synchronously with the upstream-side paper feed roller 31 is disposed on the downstream side of the inkjet head 18. A pressure roller 35 (a part of the paper feed roller pair) that turns in conjunction with the downstream-side paper feed roller 34 is pressed against the downstream-side paper feed roller 34 with the printing paper 12*a* therebetween. The upstream-side paper feed roller 31 and downstream-side paper feed roller 34 are synchronously driven rotationally by a paper feed motor 32 disposed to the printer case 2.

Figure 4:
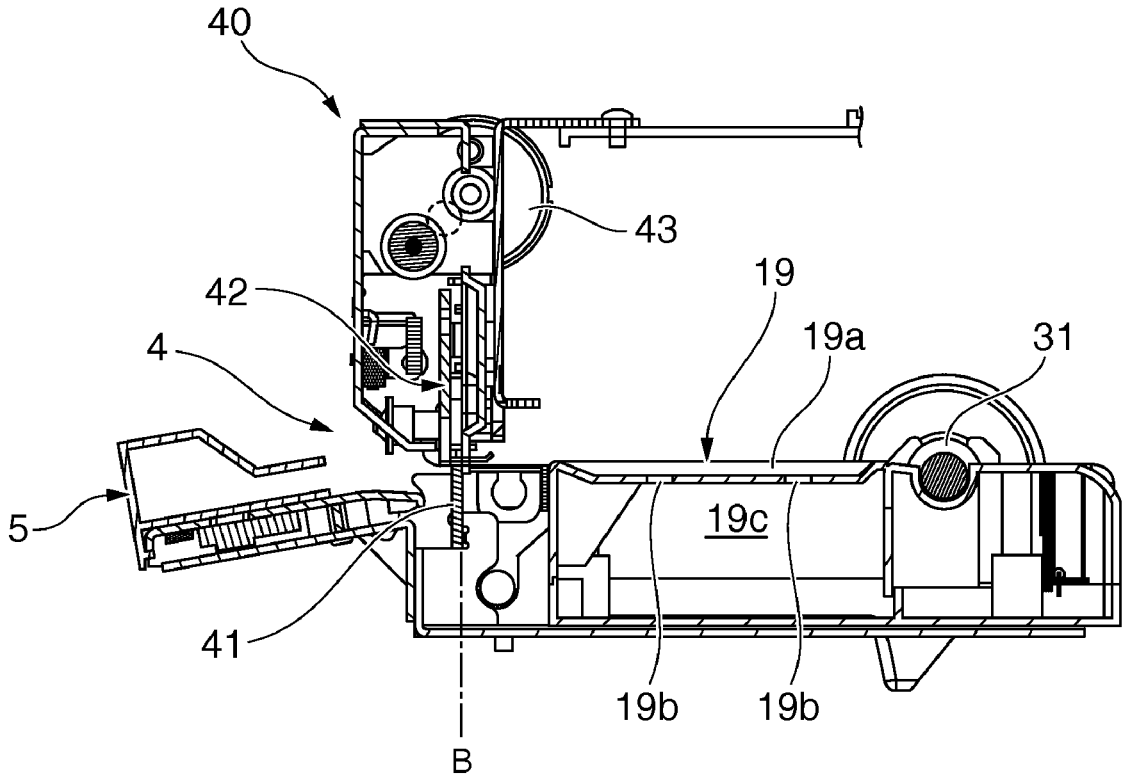
FIG. 4 is a partial section view showing the paper cutter and the platen.

FIG. 4 is a partial section view showing the automatic paper cutter 40 (cutting mechanism) and the platen 19. The automatic paper cutter 40 is disposed near the paper exit 4 on the downstream side in the paper transportation direction from the platen 19. This automatic paper cutter 40 is a scissor cutter including a stationary knife 41 on the bottom, a moving knife 42 thereabove, and a cutter motor 43 for driving the moving knife 42. After printing, the printing paper 12*a* is cut widthwise by the automatic paper cutter 40 at a cutting position B (recording paper cutting position) near the paper exit 4.

Figure 5:
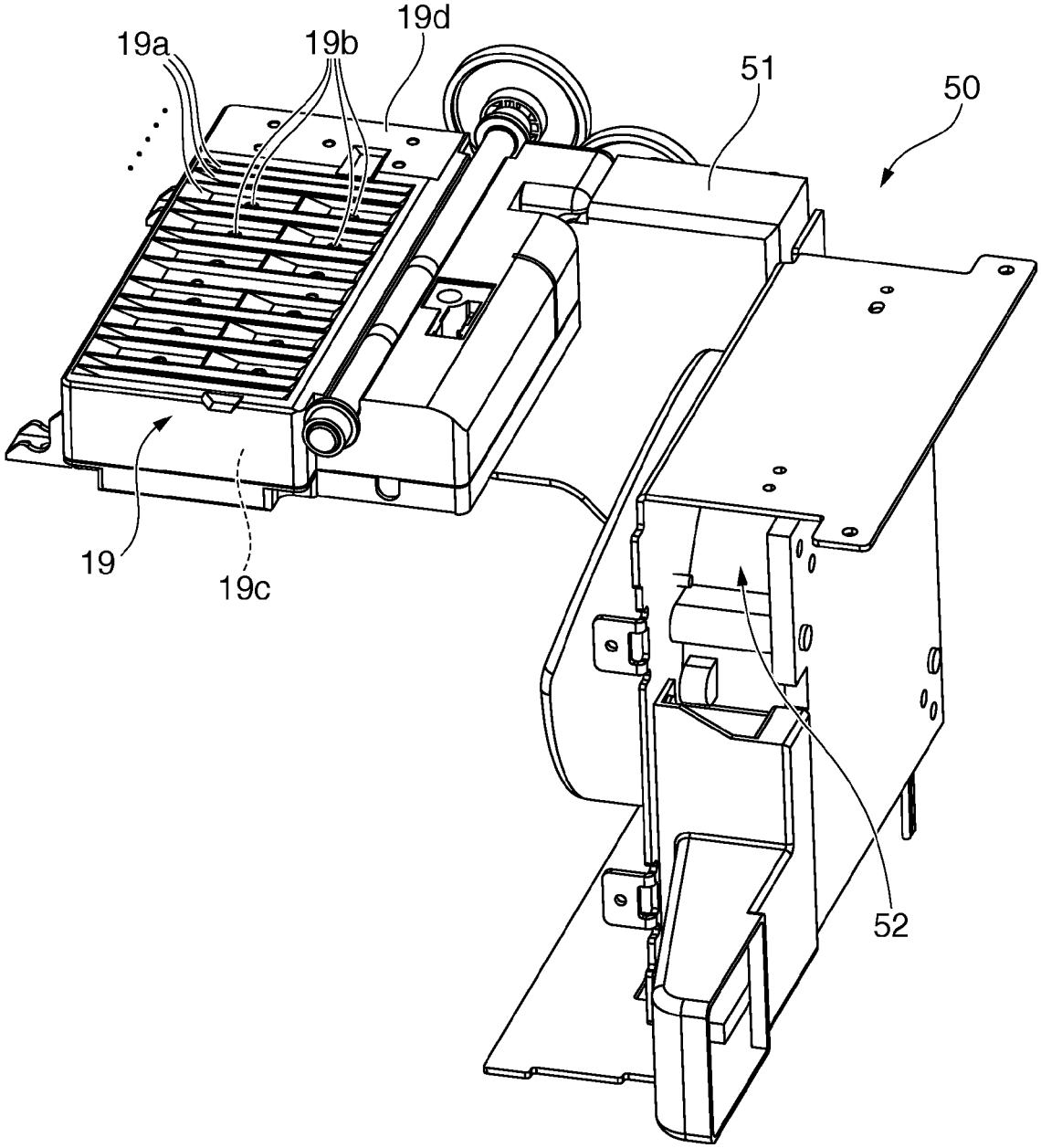
FIG. 5 is an oblique view showing the suction mechanism of the printer

FIG. 5 is an oblique view showing the platen 19 and the suction mechanism 50. As shown in FIG. 4 and FIG. 5, the platen 19 is flat and rectangular with the long side oriented widthwise to the printer. A plurality of longitudinal ribs 19*a* extending in the transportation direction of the printing paper 12*a* are formed at equal intervals on the surface of the platen 19. One or more suction holes 19*b* are formed as vertical through-holes in the bottom of each of the shallow rectangular trenches formed between the ribs 19*a*. A sealed space 19*c* is rendered below the platen 19, and the front end of the vacuum duct 51 of the suction mechanism 50 is connected to this sealed space 19*c*. The back end of the vacuum duct 51 is connected to the intake opening of a vacuum fan 52 disposed at the back of the printer 1.

The platen 19 is disposed on the roll paper cover 3*a* side of the printer and moves in conjunction with opening and closing the roll paper cover 3*a*. The sealed space 19*c* of the platen 19 is connected to the front end of the vacuum duct 51 when the cover 3 closes, and the platen 19 disconnects from the front end of the vacuum duct 51 when the roll paper cover 3*a* opens. Using the space provided to allow for movement of the head carriage 21 on which the inkjet head 18 is mounted, an ink mist recovery unit 19*d* is formed in front of the platen 19. This ink mist recovery unit 19*d* is used to recover ink mist produced by the ink droplets discharged from the inkjet head 18.

Figure 6:
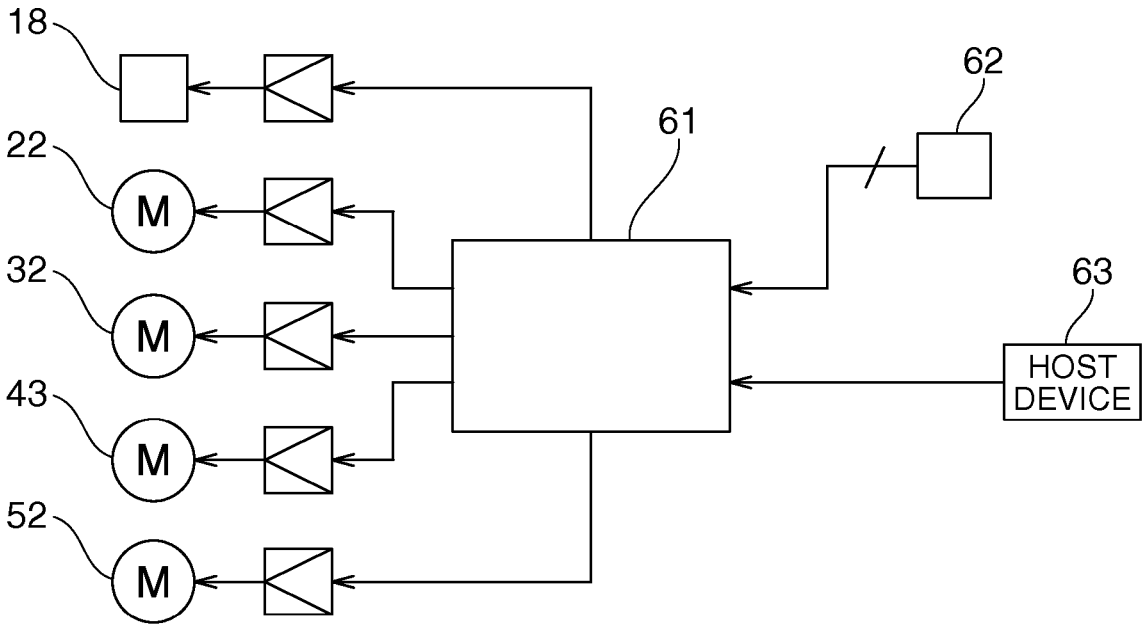
FIG. 6 is a schematic block diagram showing the drive control system of the printer.

FIG. 6 is a schematic block diagram showing the control system of the printer 1. The control system has a control unit 61 that includes a CPU, ROM, and RAM. Supplied to the control unit 61 are detection signals from a sensor group 62 including, for example, an open/close sensor for detecting opening and closing of the roll paper cover 3*a* and ink cartridge cover 3*b*, an impact sensor disposed to the outside case 2*a* of the printer case 2, a carriage sensor for detecting the position of the head carriage 21, a cutter detector for detecting the position of the moving knife 42 in the automatic paper cutter 40, an ink detector for detecting ink discharged from the inkjet head 18 during a nozzle check, a paper detector disposed to the transportation path 15 at a predetermined location, a label detector or index mark detector for detecting labels or index marks on the printing paper 12*a*, and a sensor for detecting how much ink remains in the ink cartridge. The control unit 61 controls other parts of the printer 1 based on these detection signals.

The control unit 61 controls printing on the printing paper 12*a* by driving the carriage motor 22 and inkjet head 18 synchronized to transportation of the printing paper 12*a* by the paper feed motor 32 based on print commands and print data supplied from a PC or other host device 63. If the automatic paper cutting mode using the automatic paper cutter 40 is indicated, or a paper cutting command is supplied from the host device 63, the control unit 61 controls driving the cutter motor 43 after the printing operation is completed to cut the printing paper 12*a*.

The control unit 61 also controls the suction operation of driving the vacuum fan 52 and vacuuming the printing paper 12*a* passing over the platen 19 to the platen 19 surface.

The control unit 61 also controls the head cleaning operation and nozzle check operation of the head maintenance unit 26.

Controlling Printing by the Printer

The printing operation and controlling the printing operation of the printer 1 are described next.

When a print command and print data are input from the host device 63, the control unit 61 drives the vacuum fan 52 and starts the suction operation pulling the printing paper 12*a* to the platen 19. The control unit 61 also drives the paper feed motor 32 to convey the printing paper 12*a* and position the leading end part 12*b* of the printing paper 12*a* (see FIG. 7) on the platen 19 at the printing start position A of the inkjet head 18. The control unit 61 also moves the head carriage 21 widthwise to the printer to move the inkjet head 18 from the home position 25 to a predetermined position over the platen 19. The control unit 61 then alternately repeats the operation whereby the inkjet head 18 discharges ink droplets while moving bidirectionally widthwise to the printer in the printing area 24, and the operation whereby the printing paper 12*a* is advanced one line.

Because the control unit 61 continues driving the vacuum fan 52 during this ink discharge operation and paper feed operation, the printing paper 12*a* is conveyed without lifting off the platen 19. The control unit 61 also continues holding the printing paper 12*a* to the platen 19 by means of suction after the printing operation ends. The printing paper 12*a* is then conveyed until the printed portion of the printing paper 12*a* plus a margin following the printed portion pass the cutting position B of the automatic paper cutter 40.

If the automatic paper cutting mode is enabled or a paper cut command is received, the control unit 61 stops conveying the printing paper 12*a* when the margin part of the printing paper 12*a* has passed the cutting position B, and drives the automatic paper cutter 40 to cut the printing paper 12*a* widthwise at the cutting position. After cutting, the leading end part of the printing paper 12*a* is held near the cutting position B by the downstream-side paper feed roller 34 and pressure roller 35.

To prepare for the next print job, the control unit 61 then causes the paper feed motor 32 to turn in reverse to the direction it turns during printing to convey the printing paper 12*a* in reverse and position the new leading end part 12*b* of the cut printing paper 12*a* to the printing start position A on the platen 19. The paper feed motor 32 is then stopped. The inkjet head 18 is waiting at the end of printing position over the platen 19 at this time, but because the control unit 61 continues driving the vacuum fan 52 after the paper feed motor 32 has stopped, the part of the printing paper 12*a* that is over the platen 19 does not lift away from the platen 19 and therefore does not interfere with the nozzle surface of the inkjet head 18 waiting above the platen 19.

If at this time the printer 1 has already received the next print command and print data, the control unit 61 moves the inkjet head 18 from its waiting position at the end-of-printing position and starts the next print job. If the next print command and print data have not been received, the control unit 61 retracts the inkjet head 18 to the home position 25 with the printing paper 12*a* positioned to the printing start position A, and enters the printing standby mode. The control unit 61 continues driving the vacuum fan 52 after entering the printing standby mode to hold the printing paper 12*a* at the printing start position A without lifting away from the platen 19.

Printer Control when Entering the Power Conservation Mode and Turning Printer Power Off The printer 1 enters a power conservation mode when predetermined conditions for entering the power conservation mode are satisfied in order to reduce power consumption. In this embodiment of the invention the control unit 61 sets the printer 1 to the power conservation mode when all of the following conditions (1) to (8) are satisfied and remain satisfied for at least a predetermined time. The control unit 61 therefore stores these transition conditions and the duration time in internal nonvolatile memory, for example.

(1) The printer is not printing.

(2) A print command is not input.

(3) The roll paper cover 3*a* is closed.

(4) The ink cartridge cover 3*b* is closed (5) The nozzles of the inkjet head 18 are sealed by the nozzle cap of the head maintenance unit 26.

(6) The head maintenance unit 26 is not executing the nozzle check, head cleaning, or other maintenance operation.

(7) A buzzer, indicator, or other alarm means is not sounding or lighting.

(8) An error has not been reported.

Note that the power conservation mode may alternatively be entered when any one or any combination of these conditions is satisfied.

When the power conservation mode is entered, the printer 1 stops supplying power to predetermined power consumption units such as shown in (a) to (f) below.

(a) Power supply stopped to all motors, such as the carriage motor 22, paper feed motor 32, and cutter motor 43

(b) Power supply stopped to the inkjet head 18

(c) Power supply stopped to the vacuum fan 52 that provides suction to the platen 19

(d) Of the power supply circuits for converting AC power from the commercial AC power to DC power of a predetermined supply voltage (such as 42 V, 24 V, or 12 V), the supply of power of a predetermined voltage is stopped to predetermined power supply circuits (such as 42 V and 24 V), such as those supplying power to certain drive units.

(e) Of the IC devices inside the printer 1, the power supply is stopped to predetermined devices.

(f) Of the sensors and detectors disposed to the printer 1, the power supply is stopped to predetermined sensors or detectors so that they are disabled.

Note that when the power conservation mode is entered, the power supply may be interrupted to any one or any combination of these.

The sensors or detectors that are disabled in the power conservation mode as noted in (f) above include the following.

the carriage sensor that detects the position of the head carriage 21 the open/close sensor that detects opening and closing the roll paper cover 3*a* the open/close sensor that detects detecting opening and closing ink cartridge cover 3*b* an impact sensor that detects impact to the printer case 2 an ink detector for detecting discharged ink during a nozzle check a cutter detector for detecting the position of the moving knife 42 in the automatic paper cutter 40

Note that when the power conservation mode is entered, any one or any combination of these may be disabled.

Figure 7A:
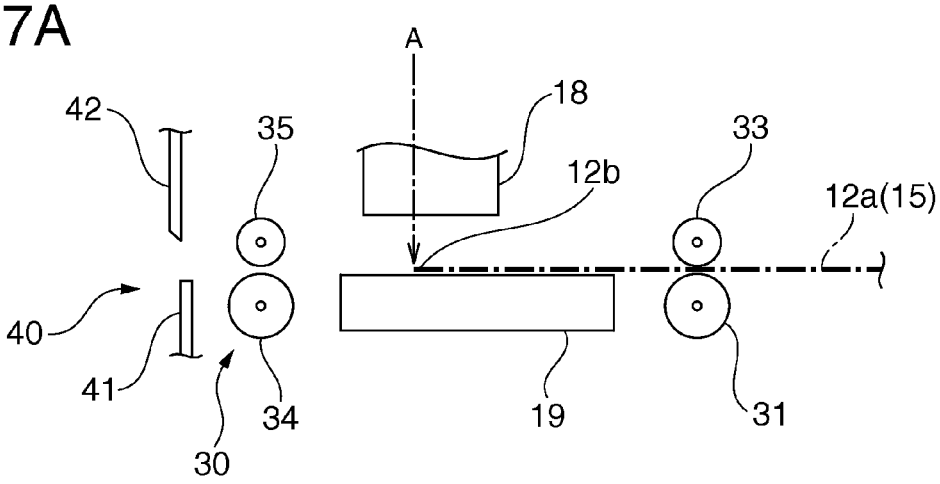
FIG. 7 describes the stopping position of the leading end of the paper.
Figure 7B:
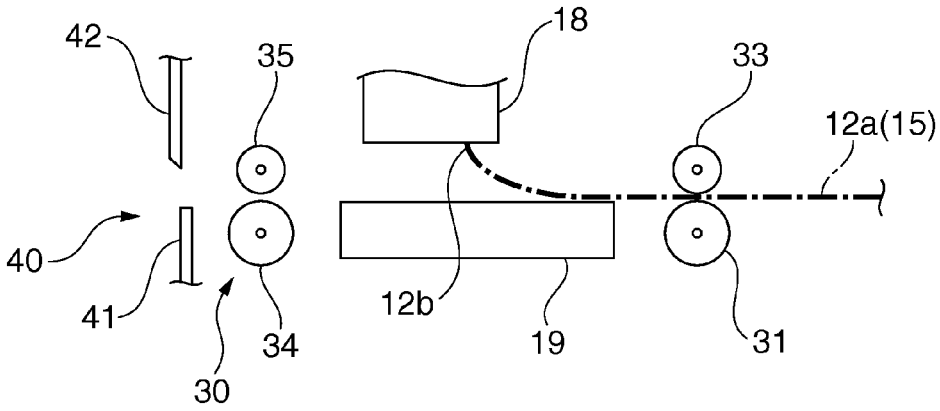
Figure 7C:
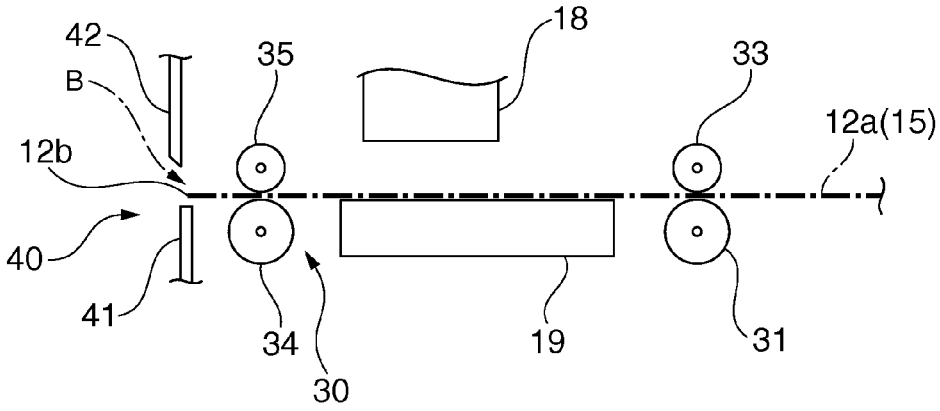

FIG. 7A, FIG. 7B, and FIG. 7C describe the stopping positions of the leading end part 12*b* of the printing paper 12*a*.

As described in condition (1) above, the printer 1 is not printing and is in the printing standby mode when it enters the power conservation mode. As shown in FIG. 7A, the leading end part 12*b* of the printing paper 12*a* is positioned to the printing start position A on the platen 19. If the power conservation mode is entered with the printer 1 in this state, suction can no longer be applied to prevent the printing paper 12*a* from rising from the platen 19 at the printing start position A because the power supply to the platen 19 stops and driving the vacuum fan 52 stops as described in (c) above. As a result, if left alone, the printing paper 12*a* will lift away from the platen 19 due to the natural curl of the paper, and it may not be possible to return the printing paper 12*a* to its original position even after driving the vacuum fan 52 resumes when the printer returns from the power conservation mode. If printing then resumes, the leading end part 12*b* of the printing paper 12*a* may contact the inkjet head 18 or other part and cause a paper jam or other printing problem.

When the printer 1 power turns off because it was turned off manually or by a power off command from the host device 63, driving the vacuum fan 52 stops and suction is therefore not applied to the printing paper 12*a*, the printing paper 12*a* therefore lifts away from the surface of the platen 19 due to the curl left in the paper and it may not be possible to return the printing paper 12*a* to its original position even after driving the vacuum fan 52 resumes when the printer returns from the power conservation mode. As a result, the leading end part 12*b* of the printing paper 12*a* may contact the inkjet head 18 or other part and cause a paper jam or other printing problem when printing then resumes.

Figure 8:
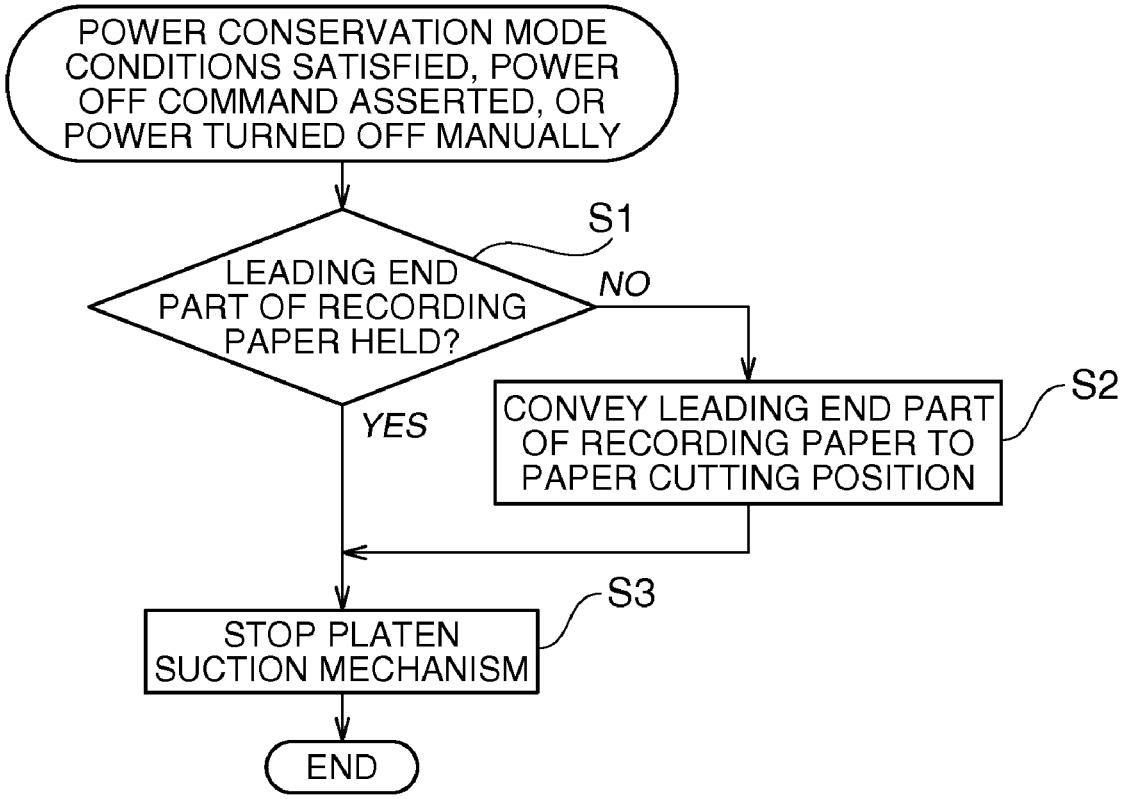
FIG. 8 is a flow chart of paper transportation control.

FIG. 8 is a flow chart of control when moving to the power conservation mode or a power off mode. When the conditions for entering the power conservation mode are satisfied, or when printer power is turned off manually or by a command as described above, for example, the control unit 61 first determines if the printing paper 12*a* is held by the paper feed roller pair including the downstream-side paper feed roller 34 and pressure roller 35 based on the detection signals from the paper detectors and other sensors in the sensor group 62 (step S1) before stopping driving the vacuum fan 52.

If the leading end part 12*b* of the printing paper 12*a* is on the printing start position A side of the gripping position of the downstream-side paper feed roller 34 and pressure roller 35, and is not held by the downstream-side paper feed roller 34 and pressure roller 35 (step S1 returns Yes), the paper feed motor 32 is driven to advance the leading end part 12*b* of the printing paper 12*a* to the cutting position B of the automatic paper cutter 40 (step S2). The vacuum fan 52 is then stopped and suction by the suction mechanism 50 stops (step S3).

However, if the control unit 61 detects that the printing paper 12*a* is held by the downstream-side paper feed roller 34 and pressure roller 35 based on the detection signals from the paper sensor, for example, in step S1 (step S1 returns No), control goes to step S3 without driving the paper feed motor 32 and driving the vacuum fan 52 stops. Because the leading end part 12*b* of the printing paper 12*a* is held by the downstream-side paper feed roller 34 and pressure roller 35 near the cutting position B after operation ends in step S3 as shown in FIG. 7C, the leading end part 12*b* of the printing paper 12*a* will not lift away from the platen 19 when the vacuum fan 52 stops.

Printer Control when Returning from the Power Conservation Mode or Power Off Mode When a new print command and print data are received from the host device 63 in the power conservation mode, the control unit 61 resumes power supply to the power consumption units noted in (a) to (f) above and starts driving the vacuum fan 52. The paper feed motor 32 is then driven in reverse to the direction when printing to return the leading end part 12*b* of the printing paper 12*a* from the cutting position B to the printing start position A on the platen 19, and printing then proceeds based on the new print command and print data.

If a command or operation other than a print command is received in the power conservation mode, power supply to the power consumption units noted in (a) to (f) resumes, the leading end part 12*b* of the printing paper 12*a* is returned to the printing start position A, and the printer enters the printing standby mode.

If the printer 1 power is off and the power is then turned on manually or by inputting a power on command, for example, the control unit 61 runs the startup process and sets the printer 1 to the printing ready mode. More specifically, driving the vacuum fan 52 starts, the paper feed motor 32 is driven in reverse to the direction when printing, and the leading end part 12*b* of the printing paper 12*a* is returned from the cutting position B to the printing start position A on the platen 19 to prepare for printing.

Effect of at Least One Embodiment of the Invention

When in the printing standby mode before switching to the power conservation mode or power off mode, the printer 1 according to this embodiment of the invention returns the leading end part 12*b* of the printing paper 12*a* to the printing start position A, pulls the leading end part 12*b* to the platen 19, and holds the leading end part 12*b* so that it does not lift away from the platen 19 into the transportation path 15. When the power conservation mode or power off mode is then entered from this state, the paper feed motor 32 is driven to return the leading end part 12*b* of the printing paper 12*a* to the cutting position B of the automatic paper cutter 40, the leading end part 12*b* is held by the downstream-side paper feed roller 34 and pressure roller 35 near the cutting position B, and driving the vacuum fan 52 is then stopped. Paper jams and other printing problems can thus be prevented because the printing paper 12*a* is held by the downstream-side paper feed roller 34 and pressure roller 35 so that it does not rise into the transportation path 15 even when the vacuum fan 52 stops operating.

Because this embodiment of the invention uses the paper feed roller pair including the downstream-side paper feed roller 34 and pressure roller 35 as the means of holding the printing paper 12*a* when the vacuum fan 52 stops operating, this embodiment of the invention does not require adding a new holding means that requires adding new parts.

Furthermore, because the stopping position of the printing paper 12*a* when the vacuum fan 52 stops is the same as the cutting position B and does not require setting a separate position, controlling transportation of the printing paper 12*a* can be simplified.

OTHER EMBODIMENTS

In the embodiment described above the leading end part 12*b* of the printing paper 12*a* is advanced to the cutting position B and held by the downstream-side paper feed roller 34 and pressure roller 35 when driving the vacuum fan 52 stops. Alternatively, the leading end part 12*b* of the printing paper 12*a* may be reversed to a position on the upstream side of the platen 19 and held there by the upstream-side paper feed roller 31 and pressure roller 33 so that the printing paper 12*a* does not rise from the transportation path 15.

Further alternatively, a holding means other than the upstream-side paper feed roller 31 and pressure roller 33 or the downstream-side paper feed roller 34 and pressure roller 35 may be disposed at a predetermined position to the transportation path 15. When the vacuum fan 52 is stopped in this configuration, the printing paper 12*a* is conveyed to this separate recording paper holding means and held thereby to the transportation path 15.

Further alternatively, the printing paper 12*a* may be held as though it is guided by the case part of the automatic paper cutter 40 near the cutting position B.

At least one embodiment of the invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An inkjet printer comprising:

an inkjet head;

a platen opposing the inkjet head;

a paper feed mechanism for conveying a paper through a transportation path define in the printer, wherein part of the transportation path is defined between the platen and the inkjet head;

a suction mechanism for pulling the paper to the platen; and a control unit that controls the paper feed mechanism to convey at least the leading end part of the paper to a first position opposing the inkjet head and waiting in a standby mode with suction applied to the paper by the suction mechanism, and when the suction operation of the suction mechanism is stopped, the control unit determines whether or not the leading end part of the paper is held by the paper feed mechanism, and if the leading end part of the paper is not held by the paper feed mechanism, the control unit controls the paper feed mechanism to convey the paper to a second position at which at least the leading end part of the paper is held by the paper feed mechanism and then to stop conveying the paper such that the paper is stopped at the second position.

2. The inkjet printer described in claim 1, wherein, when the suction operation of the suction mechanism is stopped, the control unit further determines whether or not the leading end part of the paper is at the first position, and, if the leading end part of the paper is not at the first position, the control unit controls the paper feed mechanism to convey the paper to the second position.

3. The inkjet printer described in claim 1, wherein the paper feed mechanism comprises a paper feed roller pair located on the downstream side of the platen; and the second position is a position at which at least the leading end part of the paper is held by the paper feed roller pair.

4. The inkjet printer described in claim 1, wherein the paper feed mechanism comprise a downstream-side paper feed roller pair located on the downstream side of the platen, and an upstream-side paper feed roller pair located on the upstream side of the platen;

the second position is a position at which at least the leading end part of the paper is held by the downstream-side paper feed roller pair or the upstream-side paper feed roller pair; and the control unit controls the paper feed mechanism to convey the paper to the second position if the leading end part of the paper is not held by the downstream-side paper feed roller pair when the suction operation of the suction mechanism is stopped.

5. The inkjet printer described in claim 1, wherein:

the control unit stops the suction operation of the suction mechanism when the inkjet printer is set to a power conservation mode or a power off mode.

6. The inkjet printer described in claim 1, wherein the control unit conveys at least the leading end part of the paper to the first by the paper feed mechanism when resuming the suction operation of the suction mechanism.

7. The inkjet printer described in claim 1, further comprising:

a roll paper compartment that holds roll paper composed of the paper wound in a roll.

8. The inkjet printer described in claim 1, further comprising: a cutting mechanism disposed downstream of the transportation path for cutting the paper; wherein the second position is a position at which the leading end part of the paper is disposed at the cutting mechanism.

9. A paper transportation method for an inkjet printer, the printer comprising: an inkjet head; a platen opposing the inkjet head a paper feed mechanism for conveying a paper through a transportation path defined in the printer, wherein part of the transportation path is defined between the platen and the inkjet head; and a suction mechanism for pulling the paper to the platen; the paper transportation method comprising:

conveying at least the leading end part of the paper by the paper feed mechanism to a first position opposing the inkjet head and waiting in a standby mode with suction applied to the paper by the suction mechanism; and when the suction operation of the suction mechanism is stopped in the standby mode, determining whether or not the leading end part of the paper is held by the paper feed mechanism, and, if the leading end part of the paper is not held by the paper feed mechanism, conveying the paper to a second position at which at least the leading end part of the paper is held by the paper feed mechanism and then stopping conveying the paper such that the paper is stopped at the second position.

10. The paper transportation method for an inkjet printer described in claim 9, wherein:

at least the leading end part of the paper is conveyed to the first position when suction by the suction mechanism is resumed.

11. The paper transportation method for an inkjet printer described in claim 9, wherein:

the suction operation of the suction mechanism is stopped when the inkjet printer is set to a power conservation mode or a power off mode.

12. The paper transportation method for an inkjet primer described in claim 9, wherein the inkjet printer also has a cutting mechanism for cutting the paper, and the paper transportation method further comprises:

conveying the paper to the cutting mechanism and cutting the paper;

conveying the leading end part of the paper after being cut to the first position, applying suction to the paper by the suction mechanism, and then waiting; and conveying at least the leading end part of the paper to the second position when suction by the suction mechanism is stopped while waiting.

13. The paper transportation method for an inkjet primer described in claim 9, wherein at least the leading end part of the paper is conveyed to the first position when resuming suction by the suction mechanism.

14. The inkjet printer described in claim 1, wherein the paper feed mechanism comprises a downstream paper feed mechanism disposed downstream of the platen, wherein the control unit conveys the paper by the paper feed mechanism so that at least the leading end part of the paper is held by the downstream paper feed mechanism if at least the leading end part of the paper is not held by the downstream paper feed mechanism when stopping the suction operation of the suction mechanism.

15. The inkjet printer described in claim 8, wherein the paper feed mechanism comprises a downstream paper feed mechanism disposed downstream of the platen and upstream of the cutting mechanism.

16. The paper transportation method for an inkjet printer described in claim 9, wherein the paper feed mechanism comprises a downstream paper feed mechanism disposed downstream of the platen, wherein the paper transportation method further comprises conveying at least the leading end part of the paper to a position where it is held by the downstream paper feed mechanism when the suction operation of the suction mechanism is stopped in the standby mode.

17. The paper transportation method for an inkjet printer described in claim 12, wherein the paper feed mechanism comprises a downstream paper feed mechanism disposed downstream of the platen and upstream of the cutting mechanism.

* * * * *